United States Patent [19]

Kilian

[11] Patent Number: 4,689,007

[45] Date of Patent: Aug. 25, 1987

[54] PROCESS OF THERMALLY TREATING LUMP OR AGGLOMERATED MATERIALS ON A TRAVELLING GRATE

[75] Inventor: Alois Kilian, Frankfurt am Main, Fed. Rep. of Germany

[73] Assignee: Dravo Corporation, Pittsburgh, Pa.

[21] Appl. No.: 772,564

[22] Filed: Sep. 4, 1985

[30] Foreign Application Priority Data

Sep. 8, 1984 [DE] Fed. Rep. of Germany ..... 3433043

[51] Int. Cl.[4] ..... F27B 15/00; C22B 1/20

[52] U.S. Cl. ..... 432/14; 75/5; 34/236; 266/178; 432/22; 432/78

[58] Field of Search ..... 432/14, 22, 78, 137; 75/5; 34/236; 266/178, 179, 180

[56] References Cited

U.S. PATENT DOCUMENTS 2,143,905 1/1939 Ahlmann ..... 266/178

4,373,946 2/1983 Kilian ..... 432/14

*Primary Examiner*—Henry C. Yuen

*Attorney, Agent, or Firm*—Parmelee, Miller, Welsh & Kratz

[57] ABSTRACT

The thermal treatment is effected in that hot gases are passed through the charge bed. Hot gases are passed downwardly through the charge bed in heat treating zone, oxygen-containing cooling gases are passed upwardly through the charge bed in a cooling zone, and the cooling gases which have been heated are conducted under a continuous gas hood from the cooling zone into the heat treating zone. In order to reduce the energy consumption and to lower the operating costs and the structural expenditure, the cooling gases which have been heated up are caused to flow at such a high velocity under the continuous gas hood over the upper course of the travelling grate that any vertical uplift will exert virtually no influence so that parallel layers of flowing gas at different temperatures are formed under the gas hood, fuel is supplied to individual layers of flowing gas, and individual layers of flowing gas are heated to different higher temperatures and are subsequently passed in the heat-treating zone downwardly through the charge bed.

9 Claims, 6 Drawing Figures

PROCESS OF THERMALLY TREATING LUMP OR AGGLOMERATED MATERIALS ON A TRAVELLING GRATE

FIELD OF THE INVENTION

This invention relates to a process of thermally treating lump or agglomerated materials on a travelling grate with hot gases passed through the charge bed, wherein hot gases are passed downwardly through the charge bed in a heat treating zone, oxygen-containing cooling gases are passed upwardly through the charge bed in a cooling zone, and the cooling gases which have been heated are conducted under a continuous gas hood from the cooling zone into the heat treating zone.

BACKGROUND OF THE INVENTION

Lump or agglomerated or shaped materials in any desired shape, such as limestone, ore pellets, fire-clay, and waste materials, are often thermally treated on travelling grates in that hot gases are passed through the charge on the travelling grate so that the charge is heated to predetermined temperature. The charge bed is substantially cooled by cold gases passed through the bed. The cooling gases which have been heated are supplied to the heat treating zone and used as a primary gas and/or secondary gas for the burners. The heat treating zone usually comprises a drying zone, a heating-up zone and a burning zone, each of which may be subdivided. The cooling zone is also subdivided in most cases.

It is known from U.S. Pat. No. 3,172,754 in connection with the hard-burning of pellets to provide over the first cooling zone a gas hood, which opens into a continuous duct, which extends over the afterburning zone, burning zone and heating-up zone. That duct communicates with said zones through openings provided in the roof structure over said zones. The hot cooling gases flow through said openings as secondary air and mix with the flue gases which flow from the laterally disposed burners into said zones. Whereas the continuous duct eliminates the need for separate gas lines, the mixing of the flue gases and the secondary air is poor so that the temperature distribution and the distribution of oxygen in the gases and in the bed are also adversely affected.

It is known from U.S. Pat. No. 3,620,519 to provide a continuous gas hood over the first cooling zone, the burning zone and the heating-up zone. In said gas hood, another, lower gas hood extends over the afterburning zone and a preliminary cooling zone and receives cooling air which has flown upwardly through the charge bed and delivers said cooling air to pass downwardly through the charge bed in the afterburning zone. The heated cooling air which rises into the continuous gas hood in the first cooling zone is heated up by laterally disposed burners and is used as secondary air for burners. The burners are disposed over the first cooling zone or in the passage over the second, lower gas hood. The heated gases then flow under the gas hood into the burning and heating-up zones and are passed downwardly through the bed in said zones. A partial transverse wall is provided between said zones. In said process, all gases are heated up in the cooling zone to the highest temperature required and must subsequently be cooled, e.g., in the heating-up zone to the temperature which is required there, by an addition of cold air. As a result, gas at the maximum volumetric rate becomes available in the cooling zone, the continuous gas hood must have a correspondingly large cross-section. The heat losses at the walls are large, and a cover consisting of a second gas hood is required over the afterburning zone and causes a deposition of dust and a formation of crusts.

European Pat. No. 0 030 396 discloses that at least part of the fuel supplied from the outside to the burning process is charged as solid fuel onto the surface of the pellet bed and that a continuous gas hood is provided over the first cooling zone, the burning zone and the heating-up zone. If heating is effected only by a combustion of the solid fuel supplied onto the bed, the gas hood will have no internal fixtures. If only part of the heat required is supplied by the combustion of that solid fuel, then internal fixtures will be provided over the heating-up and burning zones and said internal fixtures will be provided on their side walls with combustion chambers, which communicate with the gas hood through ducts, through which heated cooling air supplied as secondary air to the combustion chambers. Advantages afforded by both embodiments reside in that the combustion of the solid fuel results in a highly uniform heating of the gases and that the volumetric gas rate is relatively low. But any burners which are used can be operated only under a lower load and nevertheless there will be a certain problem regarding the deposition of ash in the ducts. In both cases, inexpensive solid fuels may be used and the energy costs will be lowered in dependence on the rate at which solid fuel is charged. On the other hand, solid fuel is not available in all cases and it may be desired to permit a selective use of liquid or gaseous fuel.

SUMMARY OF THE INVENTION

The present invention is directed to a process for thermally treating lump or agglomerated materials on a travelling grate with hot gases passed through the charge bed. The hot gases are passed downwardly through the charge bed in a heat treating zone, oxygen-containing cooling gases are passed upwardly through the charge bed in a cooling zone, and the cooling gases which have been heated are conducted under a continuous gas hood from the cooling zone into the heat treating zone. The cooling gases which have been heated are caused to flow at such a high velocity under the continuous gas hood over the upper course of the travelling grate so that any vertical uplift will exert virtually no influence, so that parallel layers of flowing gas at different temperatures are formed under the gas hood. Fuel is supplied to individual layers of flowing gas and the individual layers of flowing gas are heated to different higher temperatures. The individual layers of heated gas are subsequently passed in the heat-treating zone downwardly through the charge bed.

DESCRIPTION OF THE PREFERRED EMBODIMENTS

Figure 1:
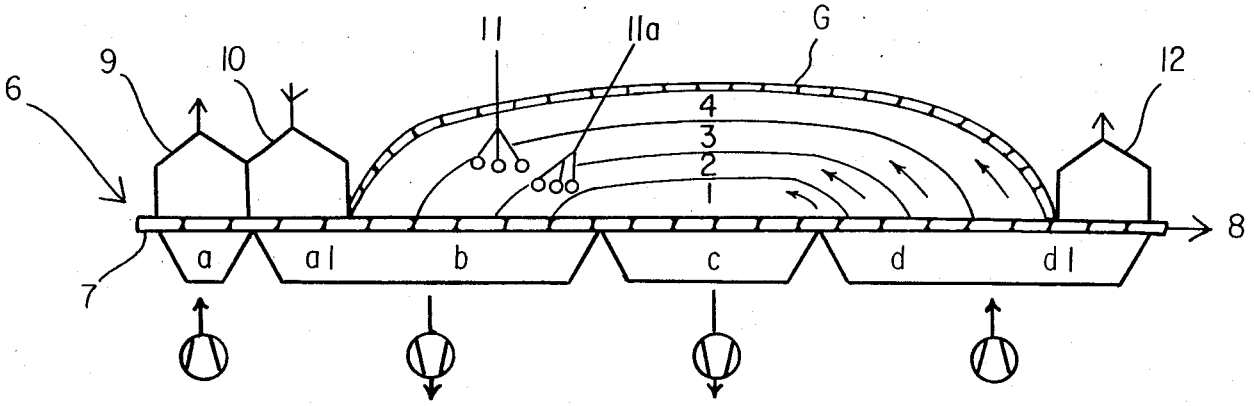
FIG. 1 as a diagrammatic transverse sectional view showing the upper courses on the travelling grates, gas hoods disposed over such upper courses, windboxes disposed under the upper courses and the layers of flowing gases under the continuous gas hood.

It is an object of the invention to reduce the energy consumption in the thermal treatment when liquid or gaseous fuel is used and to minimize the structural expenditure and the operating costs of the plant.

This object is accomplished in accordance with the invention in that cooling gases which have been heated up are caused to flow at such a high velocity under the continuous gas hood over the upper course of the travelling grate that any vertical uplift will exert virtually no influence, so that parallel layers of flowing gas at different temperatures are formed under the gas hood, fuel is supplied to individual layers of flowing gas, and individual layers of flowing gas are heated to different higher temperatures and are subsequently passed in the heat-treating zone downwardly through the charge bed. The "heat treating zone" always comprises the burning zone or, if it is subdivided, the burning zone and the heating-up zone. The drying zone may be disposed outside the continuous gas hood or may be included in the heat treating zone and in that case will be covered by the continuous gas hood. The continuous gas hood has no partitions and preferably conforms approximately to the streamlines of the layers of flowing gas. If the drying zone is not disposed under the continuous gas hood, only the first part of the cooling zone will be conducted under the continuous gas hood, the second part of the cooling zone will also be disposed under the gas hood. The cooling gas consists generally of air. If other gases are used, they must contain sufficient oxygen for the combustion of the fuel or must be enriched with oxygen. The term "layers of flowing gas" describes superimposed layers in which the gas flows parallel under the continuous gas hood. Said layers extend throughout the width of the gas hood begin where the gas exits from the charge bed in the cooling zone and terminate where the gases enter the charge bed in the heat treating zone. Owing to the pressure under which the cooling gases are forced into the cooling zone and the suction by which the hot gases are withdrawn from the heat treating zone, the gases are caused to flow in the layers of flowing gas under the gas hood at such a high velocity that the flow behavior will remain virtually unaffected by any vertical uplift under the gas hood. Any uplift will mainly be due to temperature differences between layers of flowing gas. The exact geometric configurations of the layers of flowing gas can be determined by calculation and/or by experiments made with a physical flow model. The conditions of flow in the entire system are so selected that a stable flow pattern which is stratified in a defined manner will be obtained. The individual layers of flowing gas will be heated up by an injection of fuel at different rates within the boundary lines of respective layers of flowing gas. The boundary lines and the thickness of each layer of flowing gas will be selected in dependence on the desired operating conditions. Each layer of flowing gas having a non-uniform initial temperature may be heated in an exactly defined manner to an end temperature which may be non-uniform or uniform. This may be selected in dependence on the desired operating conditions.

In dependence on the process conditions, gas at a certain rate per $m^2$ and per hour must enter the charge bed in the heat treating zone. Gas at that rate is supplied to the cooling zone by the cooling gas blower, which is controlled accordingly. If the combustion of the fuel which is supplied results in a change of the volumetric gas rate, the volumetric rate at which gas is supplied to the cooling zone must be changed accordingly.

In accordance with the preferred further feature, the velocity at which the heated cooling gases flow under the continuous gas hood at the transition from an upward to a downward direction of flow of the gases through the charge bed is in excess of 3 meters per second, preferably between 10 and 60 meters per per second. The transition from an upward flow to a downward flow is disposed at the boundary between the end of the heat-treating zone and the beginning of the cooling zone. Such a control of the velocity of flow will result in a formation of properly stratified, parallel layers of flowing gas.

In a further preferred feature, the heating up of individual layers of flowing gas under the continuous gas hood is effected as shortly as possible before the respective layer of flowing gas enters the charge bed and in such a manner that the temperature differences which are permissible in a given layer of flowing gas when the latter enters the bed will not be exceeded. The permissible temperature difference will depend on the process conditions in the zone in which that layer of flow gas enters the charge bed. For instance, in the hard-burning of pellets, the permissible difference may be relatively large, for instance, 20° to 40° C., in the heating-up zone but should be less than, e.g., 20° C. in the burning zone. The equalization of the gas temperature within a layer of flowing gas will be dependent of the ratio of the momenta of the injected fuel and of the layer of flowing gas from the admixing point to the entrance into the bed. These conditions will determine the length of the mixing zone which is required to avoid excessive temperature differences. In this manner, the heated gases will not remain at a high temperature for a long time, in which the formation of $NO_x$ might be increased. This results also in decreased structural expenses for the burning machine due to the fact that the larger effective gas volume which is due to the heating up and the high gas temperature are obtained only in a small part of the gas hood.

In accordance with a further preferred feature the fuel used to heat up a given layer of flowing gas is supplied to that layer without accompanying gas or with accompanying gas at a minimum rate. If a gas, such as natural gas, is supplied as a fuel, additional gas for imparting a momentum to the fuel to be injected is usually not required. If oil or a fine-grained solid fuel is supplied, a motive gas for imparting a momentum to the fuel to be injected is supplied only at the rate which is required for a good distribution of the fuel but without a primary or secondary gas. That motive gas is supplied a mass rate of 0.05 to 0.25, as a maximum, relative to the fuel rate. This practice will result in a very good heat balance.

In accordance with a preferred feature, layers of flowing gas which exit from the charge bed in cooling zone and contain pollutants and are at a relatively low temperature are heated up closely above the charge bed by an addition of fuel. Layers of flowing gas which exit from the charge bed in the cooling zone may contain pollutants if such pollutants are used in the cooling gases or if a second charge layer is charged in the cooling zone onto the bed of burnt material and pollutants are volatilized in a said second charge layer when the latter is heated up by the cooling gases which have been heated in the hot lower layer. The layers of flowing gas are to be heated to a temperature at which the pollutants are transformed to innocuous substances. That early heating up will ensure that such transformation will take place to a large extent. It is preferable to heat up only layers of flowing gas which exit at a low temperature, e.g., a temperature below 600° C. Any further heating up to a temperature required in the heat treating zone may be effected shortly before the layer of flowing gas enters the bed.

In accordance with a further preferred feature the continuous gas hood extends throughout the length in which a treatment is effected on the travelling grate and at least part of the layers of flowing gas from the last part of the cooling zone are not additionally heated up and are supplied to the drying zone, the coldest layer of flowing gas from the last part of the final part of the cooling zone is supplied to the first part of the drying zone, and layers of flowing gas at increasing temperatures are supplied to the next following parts of the drying zone. The continuous gas hood extends over the first and second cooling zones as well as over the drying zone, which in incorporated in the heat-treating zone. The gases are conducted in such a manner that the last layer of flowing gas leaving the second cooling zone at the end thereof and having the lowest temperature is conducted under the roof of the gas hood and is not heated up and is supplied as the first layer of flowing gas to the drying zone at the beginning thereof. Layers of flowing gas which leave the second cooling zone and precede the last of such layers are at progressively increasing temperatures in the direction which is opposite to the direction of travel of the travelling grate and are also not heated up and are supplied to the drying zone. As a result, the temperature of the layers of flowing gas supplied to the drying zone increases in the direction of travel of the travelling grate. If the temperature of a given layer of flowing gas leaving the second cooling zone is no longer sufficient for an achieving of the required temperature at the end of the drying zone, such layer of flowing gas will be heated up by an injection of fuel. Because the layers of flowing gas entering the drying zone are of progressively increasing temperatures, the drying will not result in an excessive moisture accumulation in the lower layers of the charge.

In accordance with a further feature, substitute gas is supplied from the outside to layers of flowing gas before they enter the charge bed in the heat treating zone and the volumetric rate at which the product gas enters the charge bed in the heat treating zone is adjusted to a predetermined, desired value by the control of the volumetric rate at which the cooling gases are supplied to the cooling zone. The substitute gases may consist of flue gases, reducing gases, air, oxygen-enriched gases, oxygen, or mixtures thereof. The substitute gases may become available in the same process or may consist of extraneous gas. The substitute gas is injected into the desired layers of flowing gas from the sides of the gas hood. In that manner, individual layers of flowing gas may be partly substituted in that the substitute gas is admixed, or the layers of flowing gas may be entirely substituted by the substitute gas. By the term "substitute gas" it is indicated that the volumetric rate at which gas is required per $m^2$ and per hour in the heat treating zone is not entirely supplied by heated cooling gas from the cooling zone but part of said rate is supplied as substitute gas so that the volumetric rate of the cooling gas is reduced by the volume of the substitute gas. If the substitute gas is a reactive gas and takes part in chemical reactions which result in a change of the gas volume, that change in volume will be taken into account in the control of the volumetric rate at which the cooling gas is supplied in such a manner that the volumetric rate at which the product gas enters the charge bed always equals the desired volumetric gas rate. The volumetric gas rate at which the cooling gas is supplied is preferably controlled in that the pressure in the gas hood over the heat treating zone is measured and the cooling gas blower is controlled to maintain that pressure constant. In that case, cooling gas is supplied at such a rate that gas is always sucked off at the desired rate.

The supply of substitute gas will permit an influence on and control of chemical processes at certain locations during the thermal treatment of the material. For instance, in the hard burning of magnetite pellets or of pellets containing bonded carbon, the oxidation of the magnetite to hematite or the combustion of the carbon in the regions in which the pellet bed is at a relatively low temperature may be retarded or inhibited and may be accelerated in regions at a higher temperature. In that case, the latent heat of oxidation may be released in a stage that is at a relatively high temperature, where extraneous fuel would otherwise be required, rather than in a stage that is at a relatively low temperature, where sufficient exhaust gases from the process are available to heat up the bed.

In accordance with a further feature, the material which has been heat-treated is partly cooled and reducing gases are subsequently passed through the charge bed in a reducing zone. When sponge iron is produced by a direct reductant of iron oxide containing materials below the melting point of such materials, the material which contains iron oxide is first hard-burnt in the form of pellets or briquettes and then partly cooled to the reduction temperature and is subsequently reduced to sponge iron in a reducing zone, in which reducing gases are passed through the charge. The sponge iron at a high temperature may then be charged to a melting unit. The gas leaving the reducing zone still contains reducing constituents and may be recycled to the gas generator for strengthening or may be supplied as a fuel to the heat treating zone. The reducing zone will be provided with a separate gas hood if the sponge iron is discharged in a hot state. The reducing gas may be passed downwardly or upwardly through the bed.

In accordance with a further feature, the material which has been reduced in the reducing zone is cooled in an additional cooling zone. A continuous gas hood extends throughout the travelling grate, exhaust gases from the heat treating zone and/or the reducing zone are used as a cooling gas, which in the additional cooling zone is passed upwardly through the reduced material, the layers of flowing gas from the additional cooling zone are conducted under the gas hood as upper layers of flowing gas to the heat treating zone, and the reducing gases are used as substitute gases and supplied into the gas hood over the reducing zone and are passed downwardly through the charge bed. In some cases the sponge iron must be cooled under non-oxidizing conditions as far as the sponge iron is concerned before the latter is discharged. Such cooling is effected in one or more cooling zones which succeed the reducing zone.

The cooling gases passed upwardly through the bed may consist of low-oxygen gases from the heat treating zone, exhaust gases from the reducing zone or a mixture thereof. The exhaust gases are previously cooled in heat exchangers to the required cooling gas temperature. Low-oxygen exhaust gases become available in the heat treating zone in the wind boxes disposed under layers of flowing gases in which fuel has been burnt for heating up. The lowest oxygen content is required in the first cooling zone whereas somewhat higher oxygen contents are permissible in the subsequent cooling stages. In the reducing zone the reducing gas is injected closely above the bed and is distributed at locations which are distributed over the length of the reducing zone. The reducing gas acts as a substitute gas and replaces those layers of flowing gas which would otherwise be conducted from the cooling zone to the reducing zone. As a result, there is no need for partitions. Chemical reactions between adjacent layers of flowing gas may be prevented by intervening then layers of flowing barrier gas which has a suitable chemical composition and consists, e.g., of flue gas. The barrier gas is suitably used as a substitute gas and is injected closely above the bed but may alternatively be supplied below the grate cars. The exhaust gas from the reducing zone has a low calorific value and may preferably be injected as substitute gas into the layers of flowing gas supplied to the heating-up zone and at the beginning of the burning zone or may be mixed with fresh reducing gas for use as a substitute gas which has a higher calorific value and is injected into the layers of flowing gas supplied to succeeding portions of the burning zone. Other gases which may be available, such as blast furnace gas, gas from a steelmaking process, coke oven gas, or natural gas, may be used instead of the exhaust gas from the reducing zone. The temperature of the charge in the reducing zone can be influenced by a control of the ratio of CO to $H_2$ in the reducing gas; this will also influence the temperature at which the bed enters the cooling zone. The reducing gas is suitably produced by a gasification with oxygen or oxygen-enriched air and a simultaneous high-temperature disulfurization in a circulating fluidized bed. The resulting gas has a high reduction potential and when burnt has a high calorific value. Solid carbonaceous material may be supplied to the surface of the bed at the beginning of the cooling zone to enrich the exiting cooling gases with CO and $H_2$ in the incandescent carbon layer. Such layers of flowing gas are conducted to the heating-up zone and possibly to the beginning of the burning zone so that an oxidation in said regions can be prevented and an exhaust gas will be obtained which can very well be used as a cooling gas in the first cooling stage.

In accordance with a further preferred feature the material which has been reduced in the cooling zone is cooled in an additional cooling zone, solid carbonaceous material is supplied to the surface of the charge bed, exhaust gas from the reducing zone is passed upwardly in the additional cooling zone through the bed of sponge iron and the hot carbonaceous layer formed on the bed of sponge iron, whereby said gas is strengthened, and the layers of strengthened gas are supplied as reducing gas to the reducing zone. The solid carbonaceous material is preferably supplied to the charge bed in and after the partial cooling zone to form a layer on said bed. In the partial cooling zone, the carbonaceous material is ignited by the cooling air and is partly burnt so that it is heated up. The flue gases heat up the corresponding layers of flowing gas to be supplied to the burning zone and, if desired, the heating up zone. As a result of the reduction, the exhaust gas from the reducing zone has certain contents of $CO_2$ and $H_2O$; that exhaust gas is passed upwardly through the bed in the cooling zone and is thus heated up and subsequently flows through the incandescent layer of carbonaceous material, where the $CO_2$ and $H_2O$ contents of the gas are reacted to form CO and $H_2$. The strengthened gas is returned in corresponding layers of flowing gas to the reducing zone and in the latter flows first downwardly through the layer of carbonaceous material and is thus strengthened further before it flows as reducing gas through the bed. In dependence on the particle size of the added carbonaceous material, the latter may form a deposited or a fluidized bed or may be entrained by the gases. Entrained particles will be moved with the bed into the cooling zone before they are entirely consumed. If leakage air enters the circulating reducing gas, a partial stream of the gas will be withdrawn in order to avoid an enrichment with $N_2$. The quantity which has been withdrawn is replaced by fresh reducing gas. If the sponge iron is to be discharged at a low temperature, it will be subjected to a further cooling, for which exhaust gases from the burning zone and/or heating-up zone may be used. As the temperature of the sponge iron decreases, higher oxygen contents of the cooling gases are permissible and such oxygen may be used to burn residual solid carbon provided on the bed. When the operation of the travelling grate is initiated, fresh reducing gas is supplied as substitute gas from the outside into the reducing zone.

The invention will be explained in more detail with reference to the drawings.

The drawings are diagrammatic transverse sectional views showing the upper courses of travelling grates, gas hoods disposed over such upper courses and windboxes disposed under the upper courses. The subdivision of the windboxes under the travelling grate has been omitted for the sake of clearness. The individual layers of flowing gas are shown under the continuous gas hood G. Material is charged onto the upper course 7 at 6 and discharged from upper course 7 at 8.

In accordance with FIG. 1, the charge is initially dried in a pressure drying zone a provided with a separate gas hood 9 and is subsequently dried in a suction drying zone al provided with a separate gas hood 10. The charge is subsequently heated up in a heating-up zone b and burnt in the burning zone c. The heating-up zone b and the burning zone c constitute the heat treating zone. Layers 1 to 4 of flowing gas leave the first cooling zone d and flow into the zones b and c. On both sides of the continuous gas hood G, fuel nozzles 11, **11*a* are provided, which extend into layers 2 and 3 of flowing gas slightly above the locations at which said layers enter the bed. In the second cooling zone d1 provided with a separated gas hood 12** the charge is cooled to the temperature at which it is to be discharged.

Figure 2:
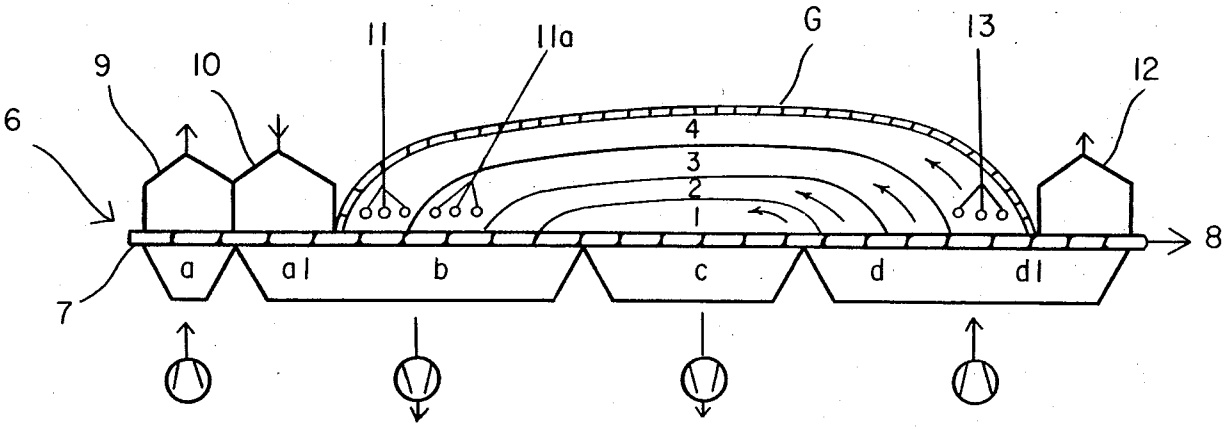
FIG. 2 is similar to FIG. 1 except for modified addition of fuel and additional solid material.

In accordance with FIG. 2, a layer of solid material is charged at 13 onto the bed at the beginning of the first cooling zone d and is heat treated by the hot cooling gas as it leaves that zone. Pollutant-containing gases leave that material. The temperature in the layers 2 and 3 of flowing gas is so high that said pollutants are transformed to innocuous compounds. The exit temperature which is required for that purpose is not reached in the layer 4 of flowing gas. For this reason, fuel is injected into the layer 4 through the fuel nozzles 11 so that the gas temperature is raised to the temperature required for the reaction. The fuel nozzles 11, 11*a* for heating to the temperature required for heat treating the charge extend into the layers 3 and 4 of flowing gas.

Figure 3:
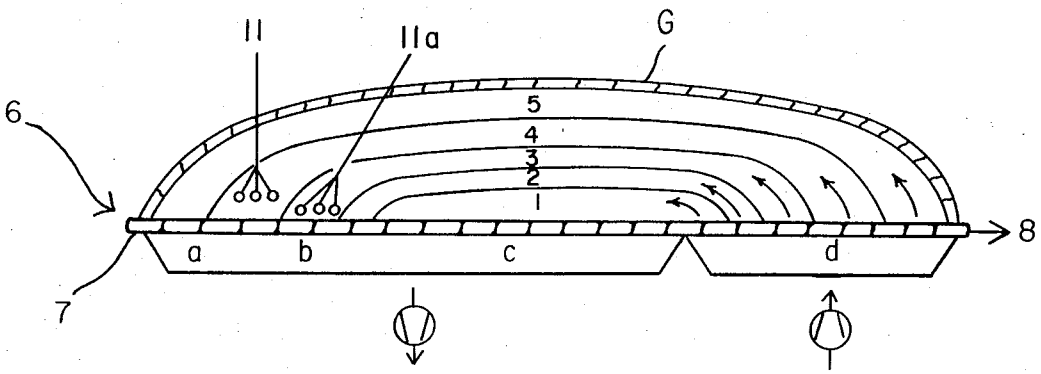
FIG. 3 is somewhat similar to FIG. 1 except that the gas hood extends throughout the length of the upper courses on the travelling grate and the presence of an additional layer in the flowing gas.

In accordance with FIG. 3, the continuous gas hood extends throughout the length of the upper course 7 and covers also the drying zone a, which also belongs to the heat treating zone. Five layers 1 to 5 of flowing gas are shown under the continuous gas hood G. The layer 5 of flowing gas entends from the last part of the cooling zone d to the drying zone a. Fuel nozzles 11, 11*a* extend into the layers 3 and 4 of flowing gas.

Figure 4:
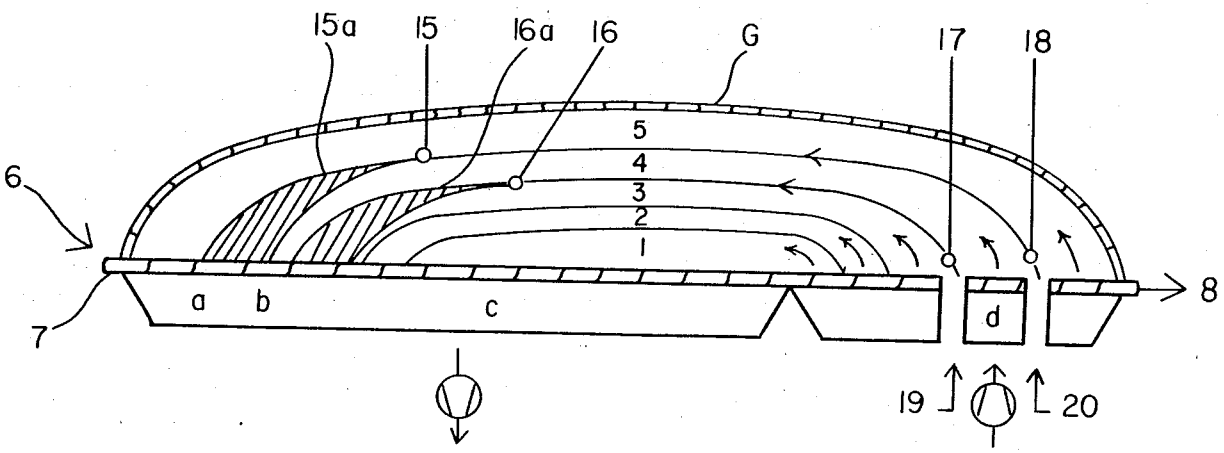
FIG. 4 is somewhat similar to FIG. 3 except for the introduction into the flowing gas stream of different oxygen-containing gases.

In accordance with FIG. 4 the continuous gas hood G extends also throughout the length of the upper course 7, and five layers 1 to 5 of flowing gas are shown under the gas hood. A low-oxygen substitute gas 15*a* is injected through the nozzles 15. A high-oxygen substitute gas 16*a* is injected through the nozzles 16. As a result, for instance, the oxidation of magnetic material or combustion of fuel in the bed is retarded in the region in which the substitute gas 15*a* enters the bed, and said reactions are accelerated at elevated temperature in the region in which the substitute gas 16*a* enters the bed. The substitute gases may also be supplied at different locations 17 or 19 and 18 or 20; this will depend on whether a complete or partial substitution of layers of flowing gas is intended. The injection within the gas hood G is effected with lower pressure differences than at the feeding points 19 and 20.

Figure 5:
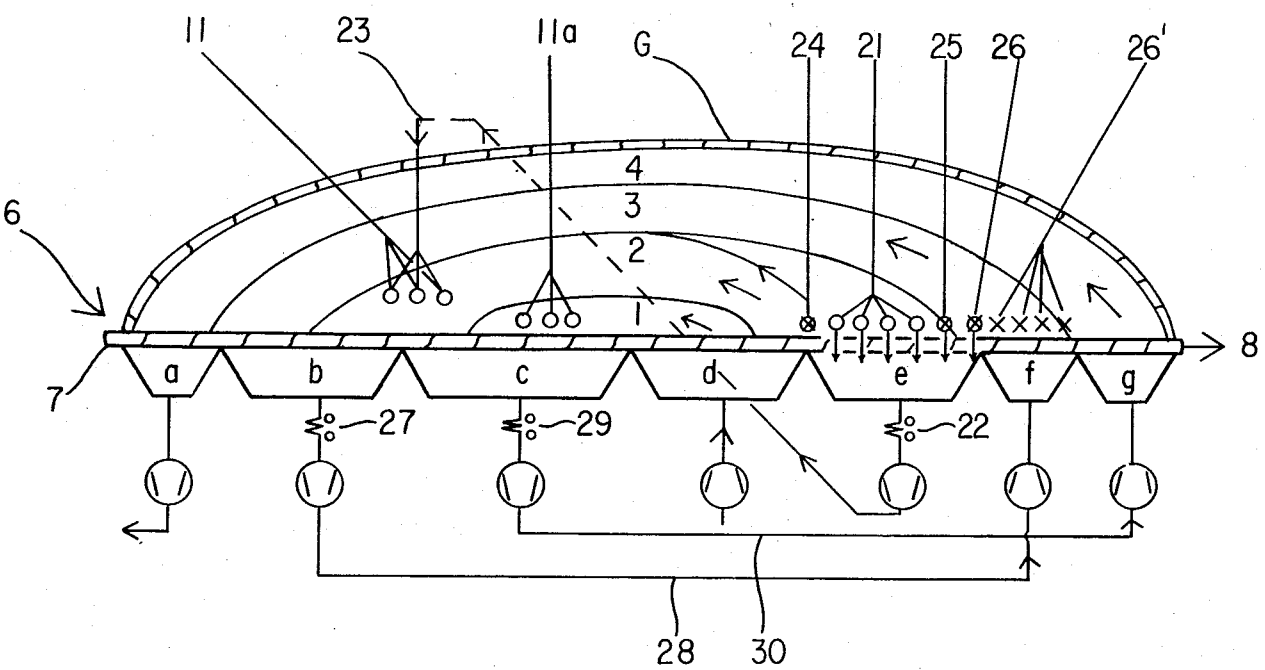
FIG. 5 is somewhat similar to FIG. 4 except that still other gases and solid fuels are introduced into the flowing gas stream.

FIG. 5 shows a combined thermal treatment with a drying zone a, heating up zone b, burning zone c and partial cooling zone d. This is succeeded by the reducing zone e, the first additional cooling zone f and the second additional cooling zone g. Reducing gas is injected closely above the bed through the nozzles 21 and is sucked through the bed, cooled in the heat exchanger 22, conducted through line 23 and injected through fuel nozzles into the layer 2 of flowing gas. A barrier gas is injected through the nozzles 24 and prevents a reaction between the layer 2 of flowing gas and the reducing gas. A barrier gas may also be injected in case of need at 25 or 26 if the layer 3 of flowing gas has a substantial oxygen content. Solid fuel for increasing the concentration of reducing components in the layer 3 of flowing gas may be charged onto the bed at 26'. The exhaust gas from the heating-up zone b is conducted through the cooler 27 and the line 28 to the first cooling zone f. A fuel gas having a higher calorific value is injected through fuel nozzles 11*a* into the layer 1 of flowing gas. The exhaust gas from the burning zone c is conducted through the cooler 29 and the line 30 to the second additional cooling zone g.

Figure 6:
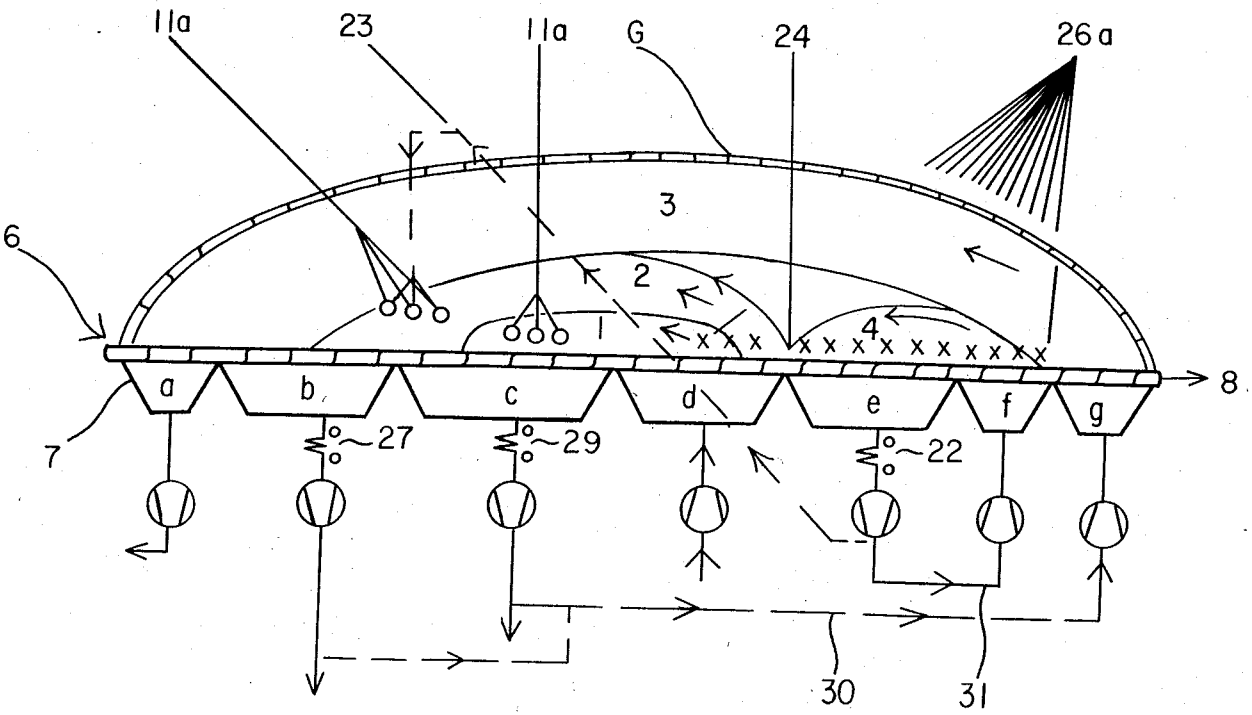
FIG. 6 is somewhat similar to FIG. 5 except that still further modifications of fuel and solid additions are shown, resulting in different flowing gas patterns.

FIG. 6 illustrates also a thermal treatment and a succeeding reduction. A difference from FIG. 5 resides in that the reducing gas is circulated and continually strengthened. That strengthening is effected in that the exhaust gas from the reducing zone e is cooled in the heat exchanger 22 and is then recycled through line 31 to the additional cooling zone f and is heated up in the bed of reduced material and is then passed through an incandescent layer of solid carbonaceous material on the bed. In that layer, $CO_2$ and $H_2O$ contained in the recycled exhaust gas react with carbon to form CO and $H_2O$. The strengthened gas forms a layer 4 of gas flowing to the reducing zone and is passed there again through the layer of solid carbonaceous material on the bed. When the gas has thus been strengthened further it constitutes a reducing gas, which enters the bed. The solid carbonaceous material is charged onto the bed at a feeding points 26*a*. The carbonaceous material charged in the further cooling zone d is partly burnt under the action of the cooling air and is thus heated up. The hot flue gases effect a heating of the layers 1 and 2 of flowing gas. A partial stream of the exhaust gas from the reducing zone is withdrawn and may be used as a fuel, which is conducted through line 23 to the fuel nozzles 11*a*. Exhaust gas from the heating-up zone b and the burning zone c may be used as a cooling gas, which is supplied through line 30 to the second additional cooling zone g.

The advantages afforded by the invention reside in that the generation of heat and gas in the system is improved so that the energy consumption is reduced and the structural expenditure and the operating costs of the plant and the pollution by pollutants contained in the exhaust gases can be reduced.

I claim:

1. A process for thermally treating a charge bed of lump or agglomerated materials on a travelling grate whereby said charge bed passes on said grate through a heat-treating zone and a cooling zone, said heat-treating zone and said cooling zone being covered by a continuous gas hood, said process comprising:

(a) causing an oxygen-containing gas to flow upwardly through said charge bed in said cooling zone into said cooling zone under said gas hood, into said heat-treating zone and downwardly through said charge bed in said heat-treating zone at a velocity between about 10 and 60 meters per second to form and maintain an uninterrupted flow of gas between said zones comprising at least two distinct stratified, parallel layers of flowing gas, said layers of gas having different temperatures;

(b) supplying fuel in fluid form to at least two of said layers of flowing gas within said heat treating zone; and (c) combusting the fuel within said fueled layers of gas above said charge bed to heat said fueled layers of gas to different, higher temperatures.

2. A process according to claim 1, characterized by heating the individual layers of flowing gas under the continuous gas hood as shortly as possible before the respective layer of flowing gas enters the charge bed and in such a manner that the temperature differences which are permissible in a given layer of flowing gas when the latter enters the bed will not be exceeded.

3. A process according to claim 1, characterized by supplying the fuel used to heat up a given layer of flowing gas to that layer with accompanying gas at a minimum rate.

4. A process according to claim 1, characterized in that the layers of flowing gas which exit from the charge bed in the cooling zone contain pollutants, are at a relatively low temperature, and are heated up closely above the charge bed in the cooling zone by an addition of fuel.

5. A process according to claim 1, whereby a drying zone precedes said heat-treating zone and characterized by extending the continuous gas hood throughout the length in which the charge bed is treated, supplying at least part of the layers of flowing gas from the last part of the cooling zone, which are not additionally heated, to the drying zone, supplying the coldest layer of flowing gas from the last part of the final part of the cooling zone to the first part of the drying zone, and supplying layers of flowing gas at increasing temperatures to the next following parts of the drying zone.

6. A process according to claim 1, characterized by supplying a substitute gas to the layers of flowing gas before they enter the charge bed in the heat treating zone and adjusting the volumetric rate at which the mixture of the substitute gas and flowing gas enters the charge bed in the heat treating zone to a predetermined, desired value by controlling the volumetric rate at which the oxygen-containing gas is supplied to the cooling zone.

7. A process according to claim 1, characterized by partially cooling the charge bed which has been heat-treated and subsequently passing reducing gases through the charge bed in a reducing zone to reduce said charge bed.

8. A process according to claim 7, characterized by cooling the reduced charge bed which has been reduced in the reducing zone in an additional cooling zone, extending the continuous gas hood over the travelling grate, passing exhaust gases from at least one of said heat treating zone and said reducing zone as a cooling gas upwardly through the reduced charge bed in the additional cooling zone, conducting the layers of flowing gas from the additional cooling zone under the gas hood as upper layers of flowing gas to the heat treating zone, using the reduced gases as substitute gases and passing the reducing gases under the gas hood over the reducing zone and downwardly through the charge bed.

9. A process according to claim 7, characterized by cooling the reduced charge bed in an additional cooling zone, supplying a solid carbonaceous material to the surface of the charge bed, passing exhaust gas from the reducing zone upwardly in the additional cooling zone through a reduced charge bed of sponge iron, whereby said gas is strengthened, and supplying the layers of strengthened gas as a reducing gas to the reducing zone.

* * * * *